United States Patent [19]

Jones

[11] 4,032,188

[45] June 28, 1977

[54] MODULAR BENCH SEAT

[76] Inventor: Ferris E. Jones, 943 Millbury Ave., La Puente, Calif. 91746

[22] Filed: Mar. 16, 1976

[21] Appl. No.: 667,288

Related U.S. Application Data

[63] Continuation-in-part of Ser. No. 537,259, Dec. 30, 1974, abandoned.

[52] U.S. Cl. ..... 297/232; 297/158; 297/443

[51] Int. Cl.[2] ..... A47C 15/00

[58] Field of Search ..... 297/157, 158, 232, 248, 297/400, 443, 451

[56] References Cited

UNITED STATES PATENTS

| | | | |
|---|---|---|---|
| 497,696 | 5/1893 | Wenzel | 297/443 X |
| 2,400,167 | 5/1946 | Resnick | 297/182 |
| 2,612,938 | 10/1952 | Dawkins et al. | 297/352 |
| 2,660,228 | 11/1953 | Reinhold | 297/443 X |
| 2,845,112 | 7/1958 | Borenstein | 297/443 |
| 3,101,218 | 8/1963 | Baermann | 297/248 X |
| 3,127,216 | 3/1964 | Clouse | 297/232 X |
| 3,329,465 | 7/1967 | King | 297/440 X |
| 3,658,382 | 4/1972 | Anderson | 297/443 X |

FOREIGN PATENTS OR APPLICATIONS

| | | | |
|---|---|---|---|
| 1,008,637 | 2/1952 | France | 297/232 |

*Primary Examiner*—Roy D. Frazier
*Assistant Examiner*—William E. Lyddane
*Attorney, Agent, or Firm*—Boniard I. Brown

[57] ABSTRACT

A modular bench seat construction composed of separate base, seat and backrest parts which may be easily assembled to form a bench seat for a dining nook or the like. These parts may be assembled in various arrangements to form differing bench seat configurations.

36 Claims, 24 Drawing Figures

50
78
24
76
10
22
4
74
52
48
48
20
7
7
42
28
18
16
32
32
34
30
4
30
14
34
12

22
78
76
10
50
48
42
18
52
74
24
20
42
48
16
28

22
50
76
10
18
48
42
78
24
52
74
42
20
48
28
16

74
80
20

54
46
48
42
10
68
58
16
26
62
40
36
56
60
44
30
12
32
64
66

54

26
58
56
60
62
66
64

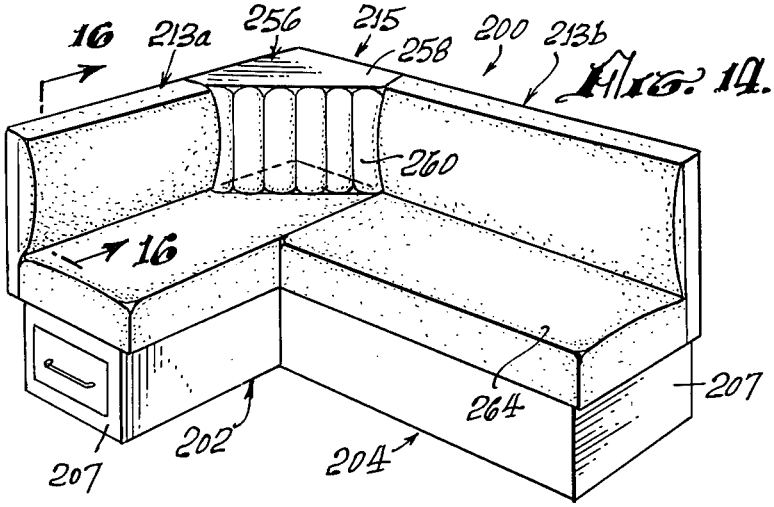
FIG. 14.
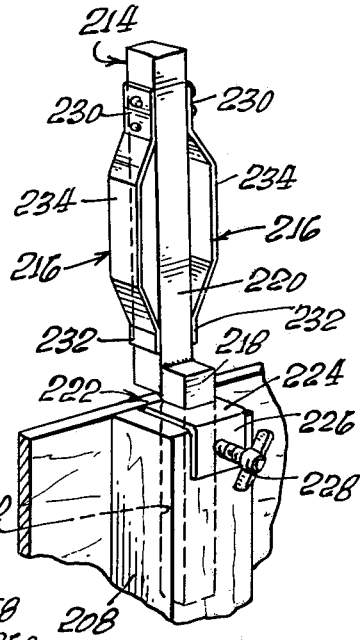
FIG. 17.
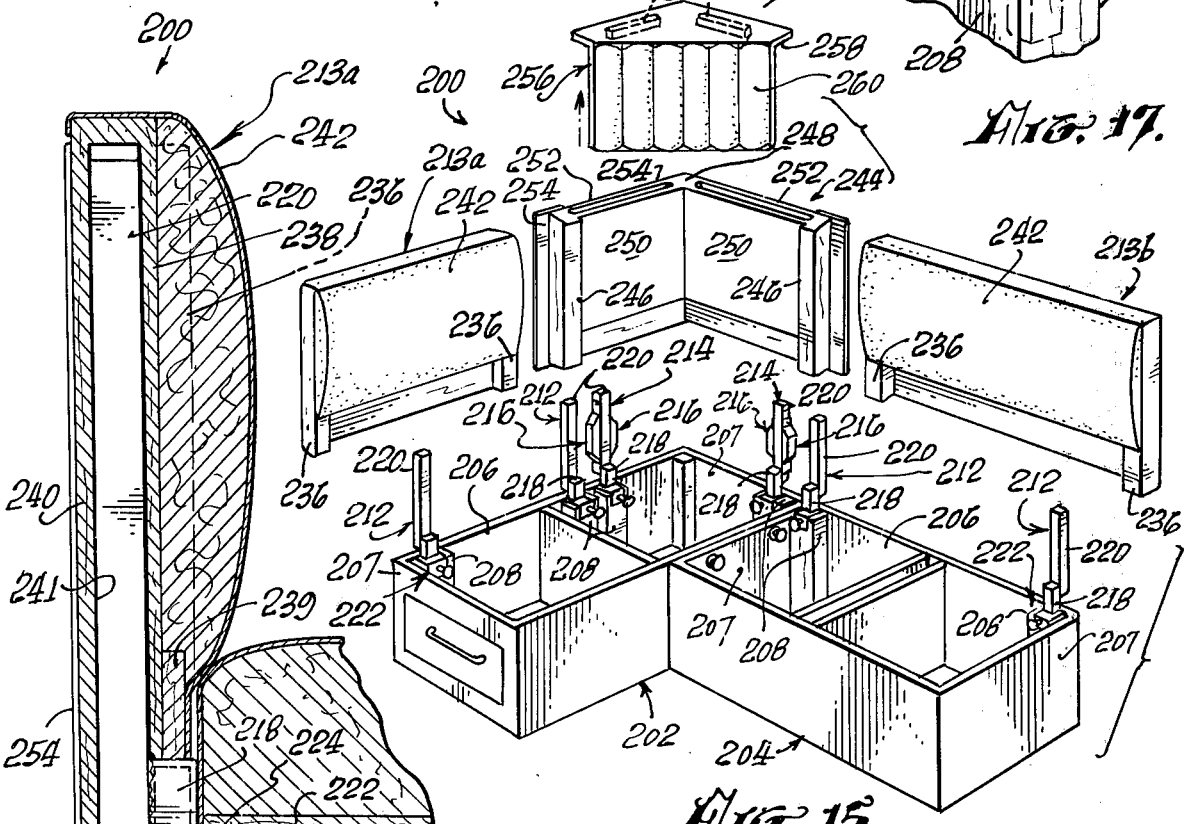
FIG. 15.
FIG. 16.

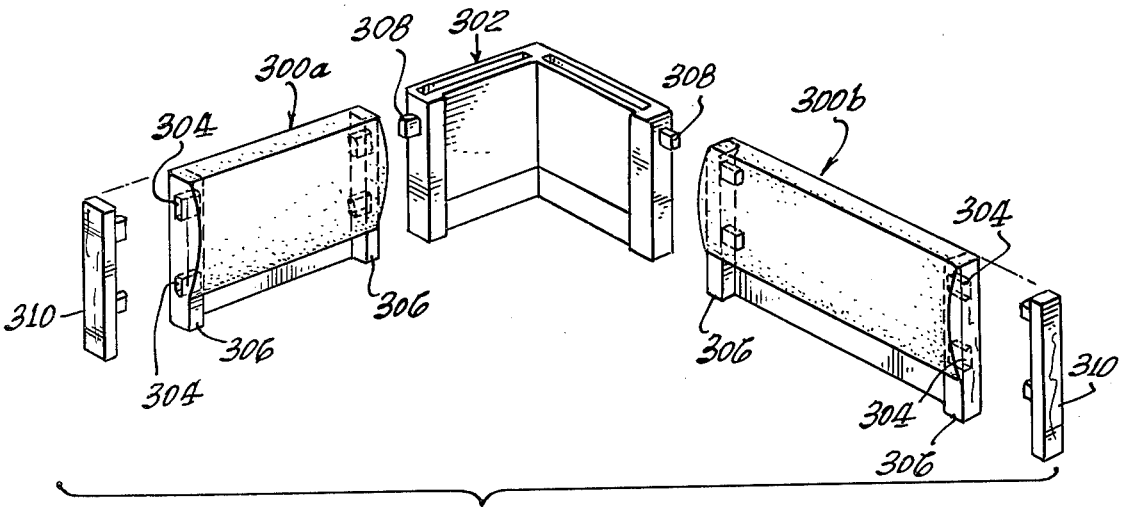
FIG. 18.
FIG. 19.
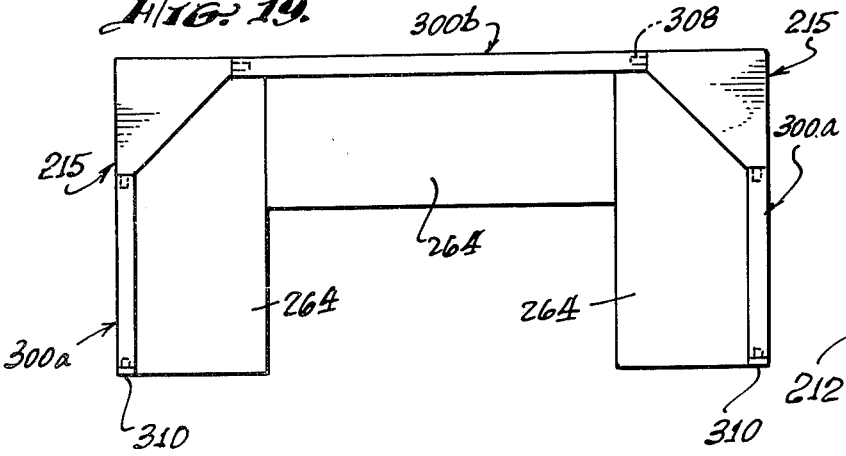
FIG. 24.
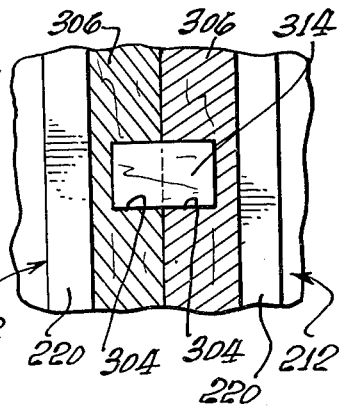
FIG. 20.
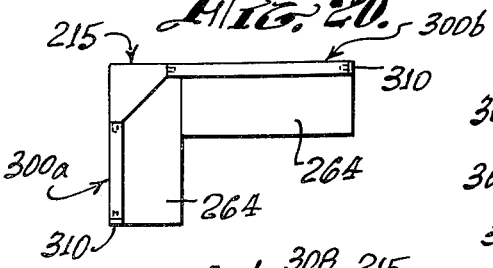
FIG. 21.
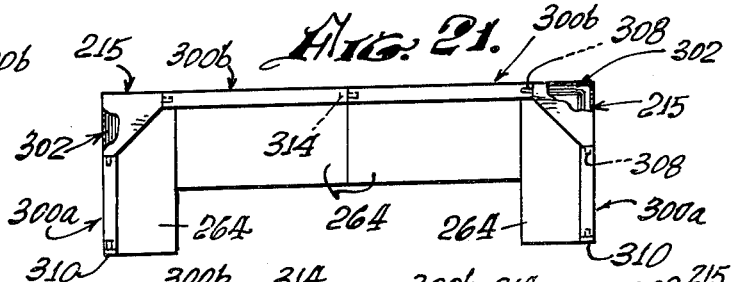
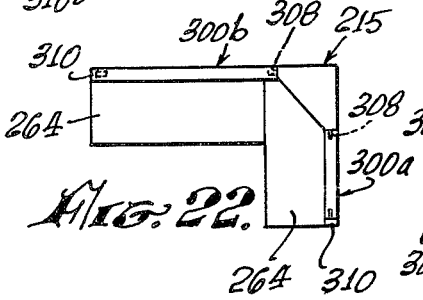
FIG. 22.
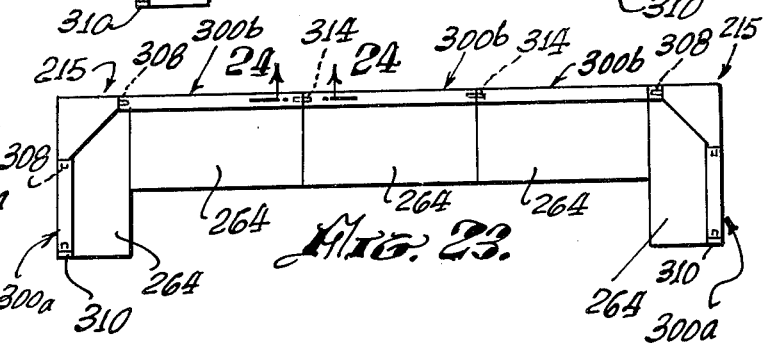
FIG. 23.

MODULAR BENCH SEAT

RELATED APPLICATIONS

This application is a continuation-in-part of application Ser. No. 537,259, filed Dec. 30, 1974, now abandoned.

BACKGROUND OF THE INVENTION

Field of the Invention

This invention relates generally to dining furniture and more particularly to a novel cushioned bench seat construction for dining nooks or the like.

Prior Art

In the context of the present invention, the expression dining nook in used in a broad sense to encompass both dining nooks for private dwellings and for commercial dining establishments, such as restaurants, coffee shops, cocktail lounges and the like. Such dining nooks include one or more bench seats and a table. This invention is concerned with bench seats for such dining nooks.

Conventional bench seats for this purpose comprise a unitary structure composed of a base, and backrest and seat cushions which are permanently joined in a bench seat configuration, generally at the seat fabricating facility. In many cases, the bench seat has a generally L-shape for conforming to a nook corner configuration. The nook table is positioned to service both legs of the seat.

The existing bench seats of this kind are deficient for several reasons. Thus, their unitary, permanently assembled construction precludes disassembly of the seats by the user when desired. Moreover, it is impossible to assemble the seat parts in various arrangements to provide bench seats of various sizes and shapes for installation in dining nook areas of differing sizes and configurations. As a consequence, a wide variety of bench seats must be fabricated to accommodate such differing nook area sizes and configurations. This bench seat construction technique is thus relatively costly and requires fabrication of a large number of differing bench seat parts. Assembly of the seat parts is also time consuming and adds substantially to the final cost of the finished bench seats.

SUMMARY OF THE INVENTION

This invention provides an improved bench seat construction of the class described which avoids the above noted and other disadvantages of the existing bench seats and their fabrication and assembly techniques. According to one aspect of the invention, the latter provides a bench seat composed of separate base, seat, and backrest parts and means for easily assembling these parts to form a finished bench seat. Assembly of the seat may be readily accomplished by the user without the use of any special tools. Moreover, the seat parts are releasibly joined in a manner which permits the user to disassemble the parts, when desired, as for example to replace a damaged part or reassemble the parts, with or without additional parts, in the same or a different seat size or configuration.

To this end, the bench seat has separate sections each including a base which may be invertable to occupy either of two upright portions of use. The section bases are releasably joined in a manner which permits them to be assembled in various numbers and configurations. Each base has a seat cushion and a backrest cushion which may be removably assembled on the base in either upright position of the base. The particular bench seats described also have at least one corner cushion which may be removably assembled on one base, in either of its upright positions, between its backrest cushion and that of the adjacent seat section to form a corner portion of the seat backrest. The backrest cushions are mounted on the seat bases by means of upright cushion supporting parts or supports, such as posts, over which the cushions slide. These cushion supports are releasibly attached to the seat bases in such a way that they may be installed in the bases in either of the upright positions of the bases.

BRIEF DESCRIPTION OF THE DRAWINGS

FIG. 14 is a perspective view of a further modified modular bench seat construction according to the invention;

FIG. 15 is an exploded perspective view of the modified seat construction in FIG. 14;

FIG. 16 is an enlarged section taken on line 16—16 in FIG. 14;

FIG. 17 is an enlarged fragmentary perspective view of the backrest supporting post shown in FIG. 16;

FIG. 18 is a perspective view of bench seat backrest cushions embodying modified means for interlocking the adjacent cushions against relative displacement;

FIGS. 19 – 23 illustrate various possible configurations of the modified bench seat construction of FIGS. 14 and 18; and FIG. 24 is an enlarged section taken on line 24—24 in FIG. 23.

DESCRIPTION OF THE PREFERRED EMBODIMENTS

Figure 1:
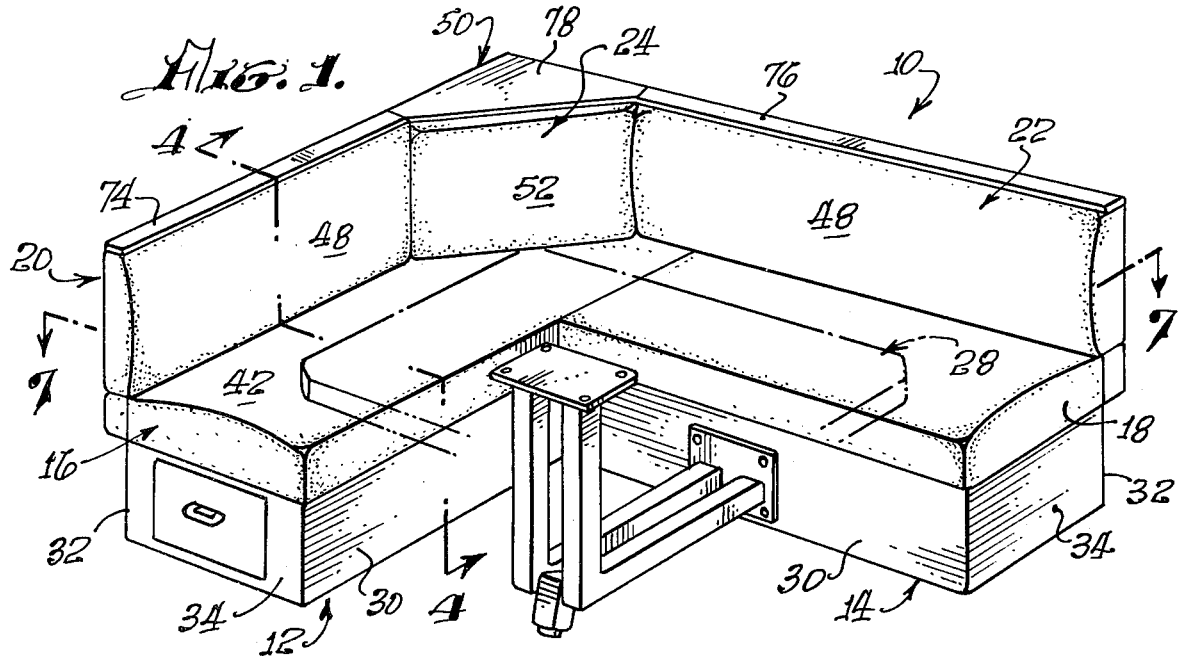
FIG. 1 is a perspective view of a modular corner bench seat construction according to the invention.

Turning first to FIGS. 1–7, the illustrated modular corner seat construction 10 comprises, in general terms, two separate seat sections having rectangular bases 12, 14 releasibly joined in an L-shape by connecting means 15. Bases 12, 14 mount removable cushioned seat portions, hereafter referred to as seat cushions, 16, 18. Along the rear sides of the bases 12, 14 are upright cushioned backrest portions, hereafter referred to as backrest cushions, 20, 22. The adjacent edges of the backrest cushions are spaced at the rear corner of the seat. Positioned between these adjacent cushion edges is a corner portion or cushion 24. The backrest and corner cushions are removably mounted on the bases 12, 14 by means 26. Base 14 mounts a table 28 which is positioned to serve both legs of the bench seat.

Figure 2:
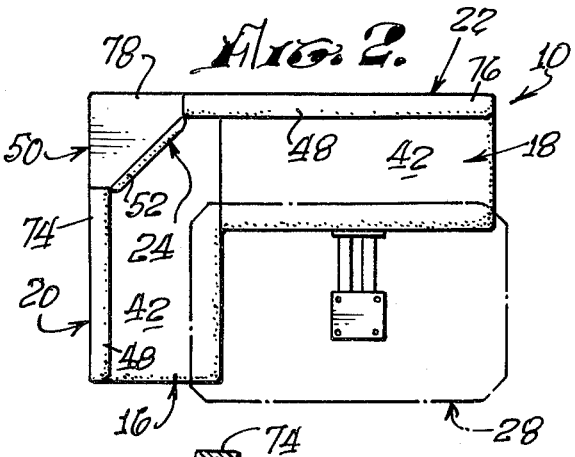
FIG. 2 is a plan view, in reduced scale, of the seat construction in FIG. 1.
Figure 3:
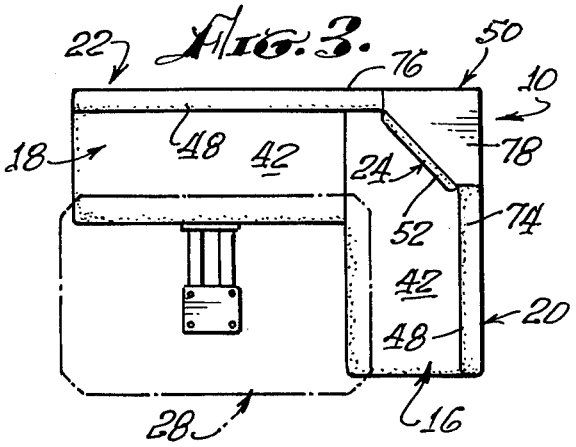
FIG. 3 is a view similar to FIG. 2 with the seat parts arranged in a different configuration.

In FIGS. 1 and 2, the various seat parts mentioned above are assembled to form a bench seat of one corner seat configuration. According to one feature of the invention, the seat parts are releasibly joined in a manner such that they may be easily assembled, by the user is desired, without the aid of special tools. Moreover, the parts may be disassembled when desired, as for example, to replace or repair a damaged part. According to another feature of the invention, the seat bases 12, 14 are invertable to occupy either of two upright positions, the cushions 16, 18, 20, 22 may be mounted on the bases in each upright position, such that the seat parts may be assembled in a variety of arrangements to form differing seat configurations, as for example, those of FIGS. 2 and 3.

Figure 6:
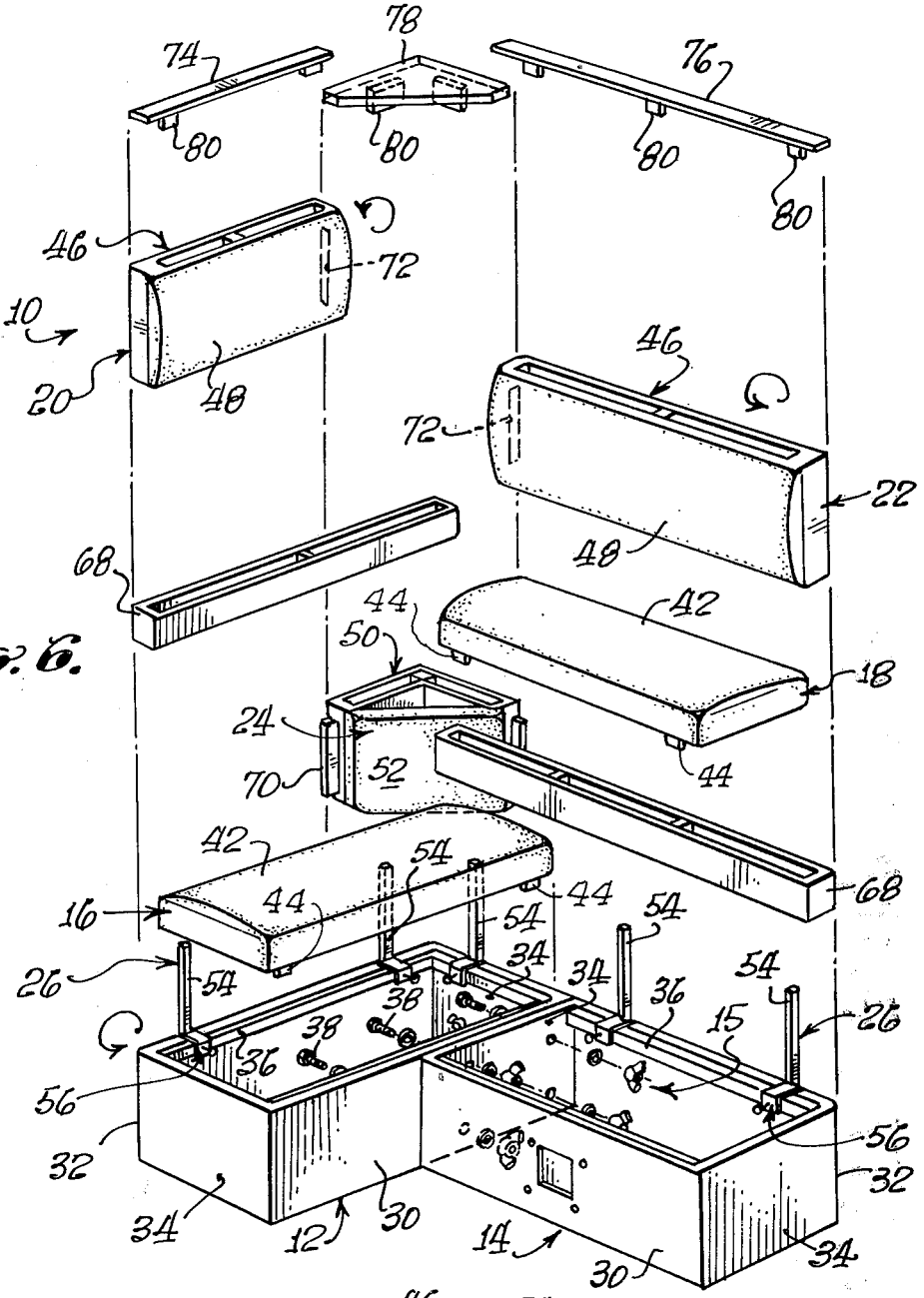
FIG. 6 is an exploded perspective view of the seat.

Referring now in more detail to the particular seat construction shown in FIGS. 1–7 of the drawings, each seat base 12, 14 has front and rear side walls 30, 32 and end walls 34. The vertically facing sides of each base, that is the top side and bottom side of each base as viewed in the drawings, are open and bounded by exposed edges of the base walls 30, 32, 34. Secured to the inner sides of the rear walls along their edges are reinforcing bars 36. As shown in FIGS. 1 and 6, one end wall 34 of base 14 seats against the front wall 30 of base 12 with the rear wall 32 of base 14 coplanar with one end wall 34 of base 12. The bases are releasibly joined by bolts 38 (FIG. 6) which pass through the contacting base walls 30, 34.

Each seat cushion 16, 18 has a hollow body 40 with an upper and frontal layer 42 of padding. The underside of each cushion body 40 rests on the upper edges of its base walls 30, 32, 34, as shown best in FIG. 4. Depending from the underside of each body are projections 44 which project into the base and engage its front and end walls to position the seat cushion in the base. Each seat cushion 16, 18 extends the full length of its base and projects slightly forwardly beyond the front base wall 30 and endwise beyond the base end walls 34. The left hand end of cushion 18 abuts the front edge of cushion 16, in FIG. 1.

Each backrest cushion 20, 22 has a hollow body 46 open along its upper and lower edges. Secured to the front side of the cushion body is a layer 48 of padding. Cushion 20 is somewhat shorter than its base 12 while cushion 22 is somewhat larger than its base 14. Cushion 20 thus terminates some distance from the rear end of its base in FIG. 1, while cushion 22 extends beyond its base over seat cushion 16. Cushion 22 terminates a distance from the rear side of base 12 equal to the distance between the rear end of cushion 20 and the rear end of its base.

Figure 7:
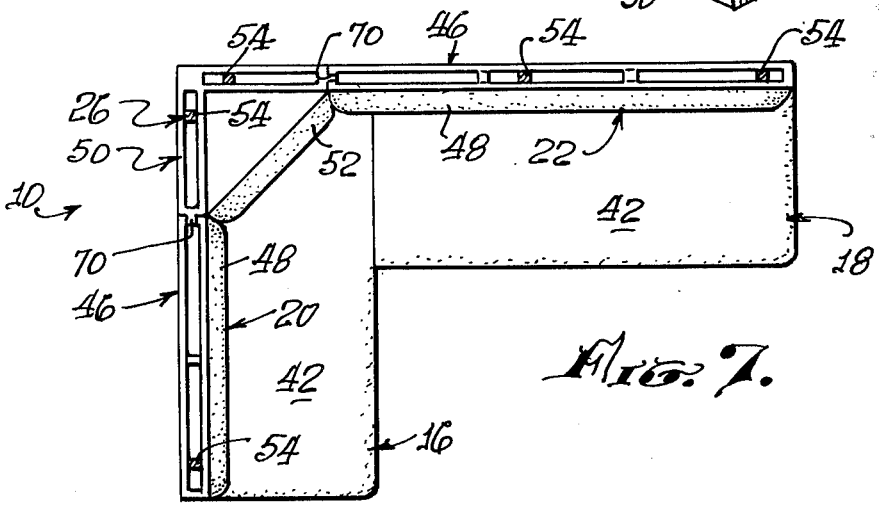
FIG. 7 is a reduced section taken on line 7—7 in FIG. 1.
Figure 8:
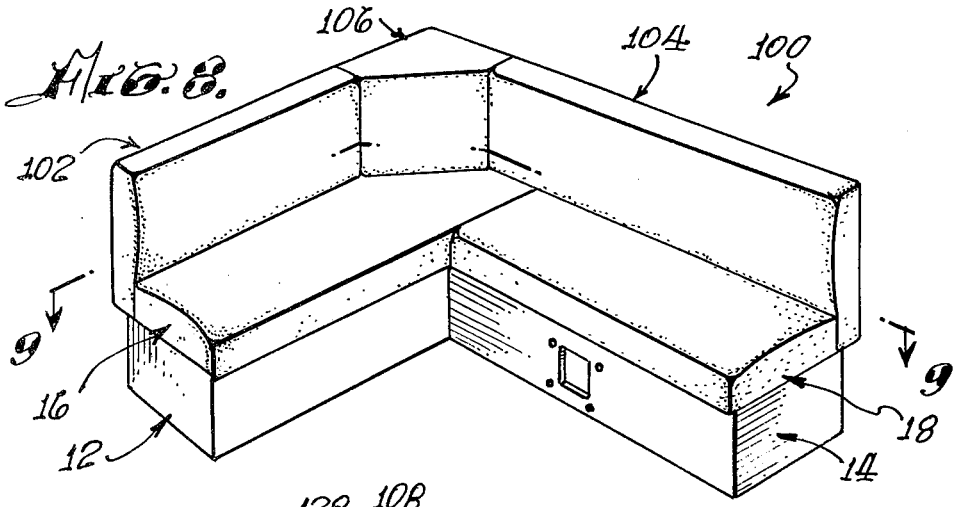
FIG. 8 is a perspective view of a modified modular corner bench seat construction according to the invention.
Figure 9:
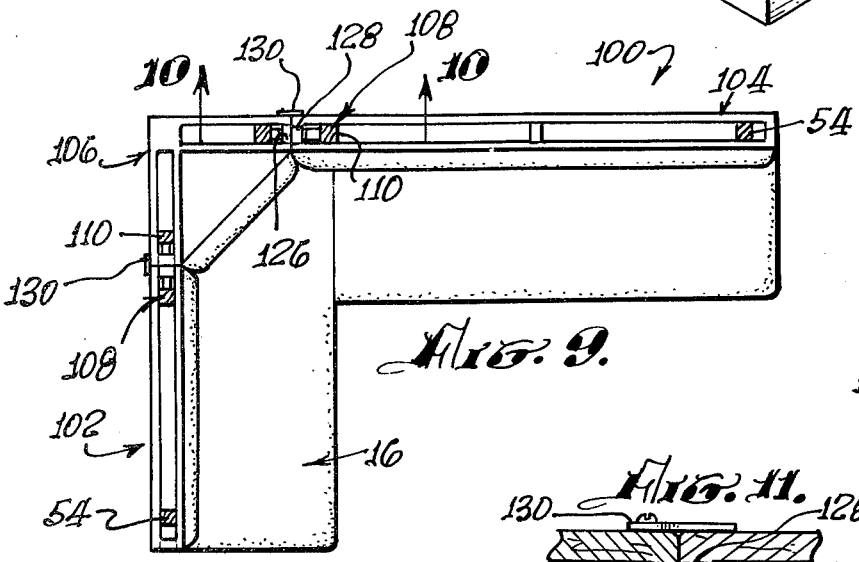
FIG. 9 is a section taken on line 9—9 in FIG. 8.

Corner cushion 24 has a generally triangular shape and is positioned between the adjacent rear edges of the backrest cushions 20, 22. As shown in FIG. 7, the corner cushion has a hollow generally L-shaped body 50 open along its upper and lower edges and a diagonal padded front side 52.

As noted earlier, the backrest and corner cushions are mounted on the bases 12, 14 by means 26. Referring particularly to FIGS, 4, 5 and 6, mounting means 26 comprises a pair of upright supporting posts 54 for each cushion. Rigidly joined to each post between its ends is a generally L-shaped bracket 56 having a normally horizontal leg 58 transverse to the post and a depending flange 60 at the outer end of the leg. Threaded in the flange is a clamp screw 62. The lower end of the post has a hole 64 for receiving a bolt 66.

Figure 4:
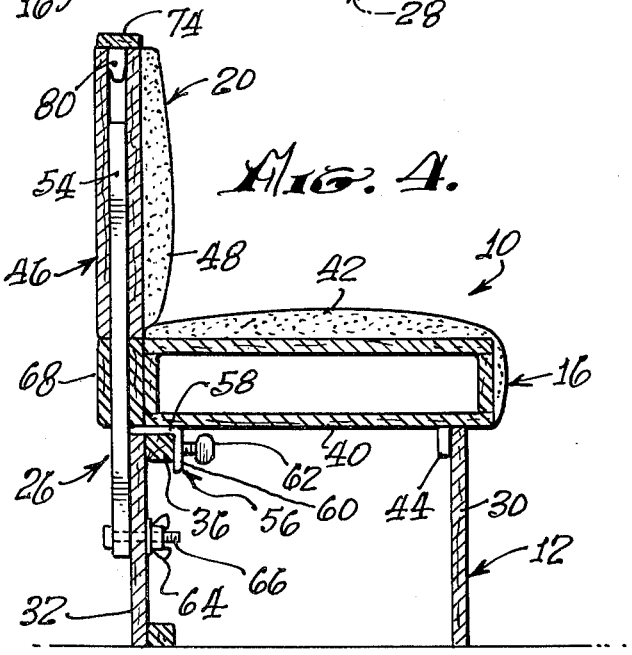
FIG. 4 is an enlarged section taken on line 4—4 in FIG. 1.
Figure 5:
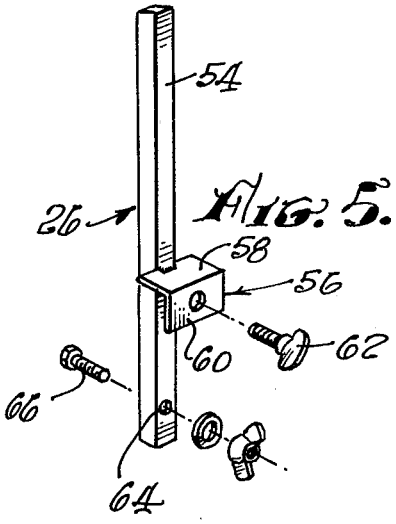
FIG. 5 is a detail of a backrest supporting post embodied in the seat.

The supporting posts 54 for each backrest cushion 20, 22 are positioned upright in spaced relation along the rear side of, and rise above, the respective base 12, 14 with the post brackets 56 engaging over the upper edge and reinforcing bar 36 of the base rear wall 32 and the lower ends of the posts seating against the rear side of the wall. The bracket clamp screws 62 are tightened against the rear wall and the post bolts pass through holes in the rear wall midway between its upper and lower edges to firmly attach the posts to the base. The backrest cushions 20, 22 are slidably positioned over their posts, which enter the bottom edge openings in and extend upwardly through the cushion bodies 46, as shown in FIG. 4. The lower edges of the backrest cushions rest on hollow spacers 68 which are slidably positioned over the posts 54 and rest on the bases, also as shown in FIG. 4. The rear edges of the seat cushions 16, 18 abut the adjacent spacers 68. The seat and backrest cushion pads 42, 44 press against one another in the manner shown.

The corner cushion 24 is mounted on the base 12 by an additional pair of posts 54 which are secured to the rear side wall 32 and rear end wall 34, respectively, of the base. These posts enter the bottom edge openings in and extend upwardly through the cushion body 50. Along the vertical edges of the body are projections or flanges 70 which enter openings 72 in the adjacent ends of the backrest cushion bodies 46 to retain the adjacent, contacting backrest and corner cushion edges against relative fore and aft displacement. Edge closure caps 74, 76, 78 are fixed to the upper edges of the backrest and corner cushions 20, 22, 24 to close their upper edge openings. These caps have projections 80 which enter the edge openings with a friction fit.

FIGS. 1 and 2 illustrate one corner configuration of the bench seat construction 10. The seat parts may be assembled in other arrangements, such as that shown in FIG. 3, however, this is accomplished by inverting the bases 12, 14 and the backrest cushions 20, 22, removing the cushion caps 74, 76 and installing the latter along the opposite backrest cushion edges, and by reassembling the supporting posts 54 and the seat, backrest and corner cushions on the inverted bases following rejoining of the latter in their positions of FIG. 3. The seat parts may obviously be assembled in other arrangements.

The modified seat construction 100 of FIGS. 8 – 13 is identical in many respects to the seat construction of FIGS. 1 – 7. Accordingly, only the differences in the seat construction 100 will be described in detail, and common seat parts will be identified by the same numerals used in FIGS. 1 – 7.

Figure 12:
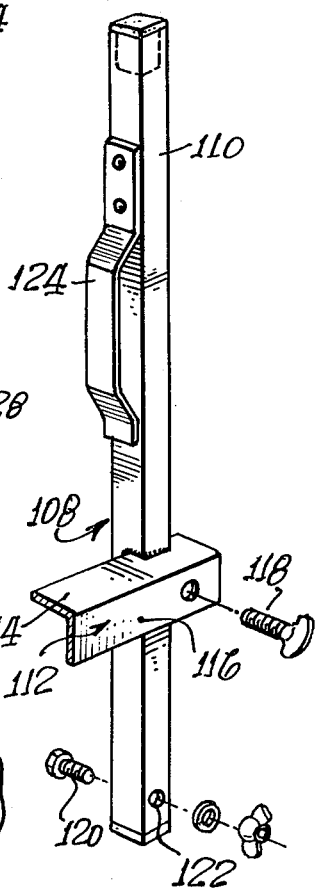
FIG. 12 is an enlarged fragmentary detail of a backrest supporting post embodied in the set of FIG. 8.
Figure 11:
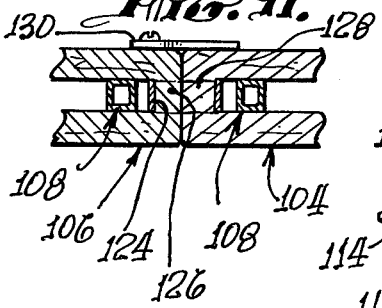
FIG. 11 is a section taken on line 11—11 in FIG. 10.
Figure 10:
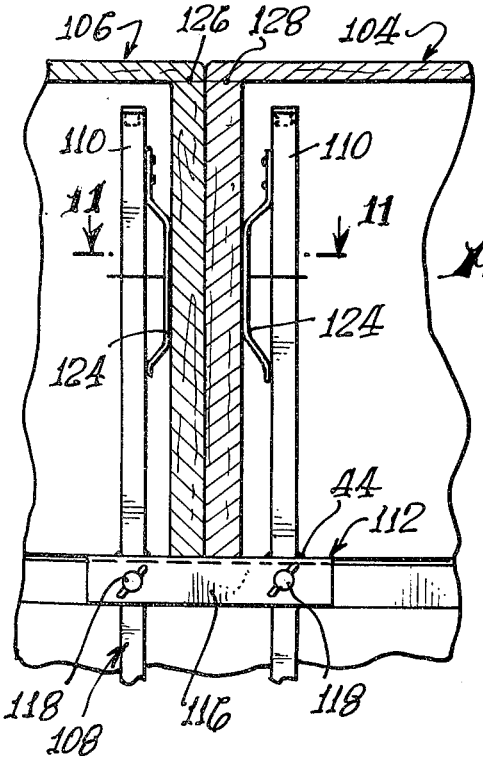
FIG. 10 is an enlarged section taken on line 10—10 in FIG. 9.
Figure 13:
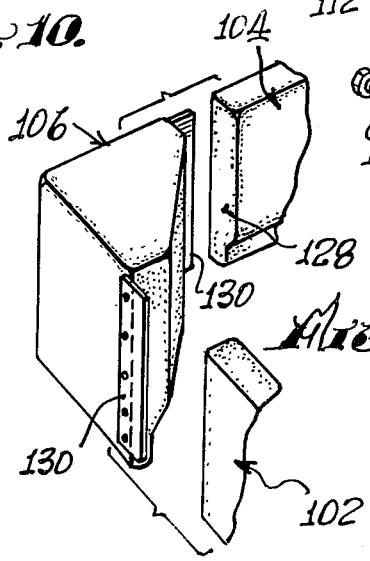
FIG. 13 is a fragmentary perspective detail of the rear corner of the seat backrest.

One feature of difference in the seat construction 100 resides in the fact that the backrest and corner cushions 102, 104, 106 have only bottom edge openings. Otherwise, these cushions are identical to those of FIGS. 1 – 7. Each backrest cushion 102, 104 is mounted on its base 12, 14 by a supporting post 26 identical to those of FIGS. 1 – 7 and by modified supporting post assemblies 108. Referring to FIGS. 10 and 12, each assembly 108 has a pair of parallel posts 110 properly joined between their ends by an L-shaped bracket 112. This bracket has a leg 114 transverse to the posts 110 and a depending flange 116 at the outer end of the leg. This flange carries a pair of clamp screws 118. Bolts 120 extend through holes 122 in the lower ends of the posts 110. Mounted on the upper ends of the posts 110 along their inner confronting sides are leaf springs 124 which bow inwardly toward one another.

Supporting post assemblies 108 replace the corner cushion supporting posts 54 and adjacent backrest cushion supporting posts 54 in FIGS. 1 – 7 and are secured, in the same manner as the posts 54, to the supporting bases 12, 14 in positions such that the assembly posts 110 straddle the abutting end walls 126, 128 of the backrest and corner cushions 102, 104, 106 in the manner shown in FIG. 10. The post springs 124 urge the cushion ends together. The corner cushion 106 has flanges 130 which engage behind the backrest cushions 102, 104 to restrain the abutting cushion ends against relative fore and aft displacement. The spacers 68 in the seat construction of FIGS. 1 – 7 are omitted and the lower edges of the backrest cushions 102, 104 extend behind the seat cushions 16, 18 and rest directly on the upper edges of the rear base walls. The modified seat construction 100 is otherwise identical to that of FIGS. 1 – 7 and may be assembled in various configurations in the same manner as the latter seat construction, except that it is unnecessary to invert the backrest cushions. as explained earlier in connection with FIGS. 1 – 7.

The modified seat construction 200 of FIGS. 14 – 17 is also quite similar to that of FIGS. 1 – 7 and comprises a pair of rectangular bases 202, 204 with rear side and end walls 206, 207. The bases are disposed in an L-shaped arrangement with the left end wall of base 204 in FIG. 15 seating against and releasibly secured by bolts to the front side wall of base 202.

Rigidly secured in the positions shown to the inner sides of the rear side and end walls of base 202 and the rear side wall of base 204 are upright post-like blocks 208. Extending endwise through these blocks are channels which open outwardly toward and are closed along their open outer sides by the adjacent base walls to form openings or sockets 210 for reclining upright supporting posts 212 for backrest portions or cushions **213*a*, 213*b* and upright supporting posts 214 for a corner cushion assembly 215. Posts 214 have springs 216 at their upper ends. Except for these springs, the posts 212, 214** are identical.

Each post 212, 214 has lower and upper sections 218, 220 of rectangular cross-section. These post sections are laterally offset with the upper end of the lower section overlapping the lower end of the upper section and rigidly joined to the normal front side of the upper section. At the upper end of the lower section 218 is a bracket 222 having a plate 224 rigidly joined to and extending forwardly of the section in a plane normal to its axis and a depending flange 226 at the front edge of the plate. A clamp screw 228 is threaded in the flange.

The lower post sections 218 are sized to fit slidably within the base sockets 210 to a position best shown in FIG. 16. In this position, the lower ends of the upper post sections 220 rest on the upper edges of the adjacent base walls 206, 207 and the post bracket plates 224 rest on the upper ends of the base blocks 208. The bracket flanges 226 depend along the front sides of the blocks, and the screws 228 are tightened against the blocks to secure the posts to the bases.

As noted earlier, the posts 212, 214 are identical except for the springs 216 on the posts 214. Each post 214 has a pair of the springs secured to opposite sides of the upper post section 220. Each spring 216 has an upper end 230 secured flat against the upper post section, a lower end 232 in flat sliding contact with the post section, and a center outwardly arching portion which is flexible toward the post section.

Base 202 has a post 212 at its rear left hand corner in FIG. 15, a post 214 at its front right corner, and posts 212 and 214 between the ends of the rear wall. Base 204 has a pair of posts 214 at the ends of its rear wall.

Each backrest cushion **213*a*, 213*b* has a pair of upright post-like end members 236 and front and rear panels 238, 240 extending between and secured to the end members to form a relatively rigid backrest frame. The rear panels 240 are secured to the rear sides of the end members. The front panels 238 extend between and are secured at their ends to the inner confronting sides of the members, such that the spacing between the panels approximates or is slightly greater than the fore and aft thickness dimension of the upper sections 220 of the backrest support posts 212.**

As shown in FIG. 16, reinforcement member 239 is secured to and extends across the lower portion of the front panel 238.

The lower ends of member 239 and front panel 238 rest atop the end of lower post section 218 to support the backrest cushion.

Attached to the front side of this frame is a resilient cushion pad 242. The end members 236 and rear panel 240 project below the bottom edges of the front panel 238 and cushion pad 242, as shown.

Backrest cushion **213*a* is shorter than the base 202 and is removably positioned over the upper sections 220 of the backrest supporting posts 212 on the base with the post sections extending upwardly through the space between the front and rear cushion panels 238, 240. The upper section of the right hand post in FIG. 15 seats laterally against the inner side of the adjacent right hand end member 236 of the cushion. The lower ends of the cushion end members 236 rest on the upper edge of the rear base side wall 206 to support the cushion vertically. Backrest cushion 213*a* extends only part way along the base 202 from its left end in FIG. 15 to accommodate the corner cushion assembly 215,** as explained below.

Backrest cushion **213*b* has a length substantially the same as or slightly longer than base 204 and is removably positioned over the upper sections 220 of the backrest supporting posts 212 on the base with the post sections extending upwardly through the space between the front and rear cushion panels 238, 240. The upper section of the left hand post in FIG. 15 seats laterally against the inner side of the adjacent left hand end member 236** of the cushion.

Corner cushion assembly 215 comprises an L-shaped backrest frame 244 including a pair of upright post-like end members 246, and upright post-like corner member 248, and pairs of mutually perpendicular front panels 250 and mutually perpendicular rear panels 252 extending between and secured to the members in the L-configuration shown. The rear panels 252 are secured to the rear sides of the end and corner members. The front panels 250 are secured to the inner confronting sides of the members, as shown, such that the spacing between the front and rear panels approximates or is slightly greater than the fore and aft thickness dimension of the upper backrest supporting post sections 220 and the end members 246 project forwardly of the front panels, as shown. The rear panels project below the front panels, as shown.

Corner frame 244 is removable positioned over the upper sections 220 of the backrest supporting posts 214 on base 202 with the post sections extending upwardly through the spaces between the respective front and rear panels 250, 252 of the frame. Posts 214 are located on the base 202 in such a way that their outermost springs 216, that is the springs facing the adjacent frame end members 246, press firmly against the inner sides of these members to yieldably urge the latter against the adjacent ends of the backrest cushions 213*a*, 213*b*. Each posts 214 mounts a pair of springs 216 to make these posts interchangeable. The lower ends of the frame members 246, 248 rest on the upper edges of the rear base side and end walls 206, 207 to support the corner frame vertically. Attached to the rear sides of the rear frame panels 252, along the ends of these panels, are plates 254 which overlap the rear sides of the adjacent ends of the backrest cushions 213*a*, 213*b* to resist relative fore and aft movement of the corner frame and cushions.

Corner cushion assembly 215 further includes a cushion part 256. This cushion part has a generally triangular top plate 258 and a front depending cushion pad 260 secured along its upper edge to the front edge of the plate. Depending from the underside of plate 258 are lugs 262. Plate 258 is positioned on top of the corner frame 244 with its underside seating on the top edge of the frame and its front edge and cushion pad 260 extending diagonally of the frame between its ends and the adjacent ends of the backrest cushions 213*a*, 213*b*, as shown. The plate lugs 262 are located and sized to fit snugly within the space between the front and rear frame panels 250, 252 to releasibly hold the cushion part 256 in position on the corner frame.

Also removably positioned on the seat bases 202, 204 are seat portions or cushions 264. The seat cushion on base 202 extends the full length of the base and under the corner cushion part 256 which is vertically dimensioned to normally just touch the seat cushion. The seat cushion on base 204 extends the full length of the base and abuts, at its left end in FIG. 15, the front edge of the seat cushion on base 202.

As noted earlier and shown in the drawings, the lower edges of the cushion pads 242 on the backrest cushions 213*a*, 213*b* are located a distance above the lower ends of the backrest cushion end members 236 which rest on the upper edges of the base walls to vertically support the cushions. Accordingly, when the backrest cushions are mounted on the bases, the lower edges of their cushion pads are spaced a distance above the upper sides of the bases, as shown. This spacing is sized to match the rear edge thickness of the seat cushions 264, such that when the seat cushions are mounted on the bases, their rear edges project under the backrest cushion pads in the manner shown. The seat cushions are retained in position on the bases in the same way as described earlier in connection with FIGS. 1–7.

Turning to FIG. 18, there are illustrated modified backrest cushions 300*a*, 300*b* and a corner frame 302 for the bench seat of FIGS. 14–17. These modified cushions and back frame are identical with those of FIGS. 14–17 except for the manner in which the cushions and corner frame are interconnected against relative fore and aft displacement. Thus, the modified backrest cushions 300*a*, 300*b* have sockets 304 entering the outer sides of their end members 306 and the ends of the corner frame 302 have projecting lugs 308 matching the sockets for engagement in the upper cushion sockets when the frame and cushions are assembled on the seat bases 202, 204 in the manner explained earlier in connection with FIGS. 14–17. This engagement of the lugs in the sockets interlocks the respective frame and cushion ends against relative fore and aft displacement. The sockets at the outer ends of the backrest cushions 300*a*, 300*b* are concealed by cover plates 310 having lugs 312 engageable in the sockets with a sufficiently snug fit to hold the plates in position.

The modified backrest cushions of FIG. 18 are provided with sockets 304 at both ends to permit such cushions and corner assemblies embodying the modified corner frame construction of FIG. 18 to be assembled with the other bench seat components described in connection with FIGS. 14–17 in various bench seat configurations, as illustrated in FIGS. 20–23. Other seat configurations are also possible, of course. In this regard, it will be understood that the seat bases 202, 204 and corner frame 244 are reversible or invertable, i.e. they may be placed either side up, and the supporting posts 212, 214 and cushion part 256 may be assembled on the bases and corner frame in either position thereof to maximize the possible bench seat configurations. When two backrest cushions of the kind shown in FIG. 18 are placed end to end, as in the bench seat arangements of FIGS 21 and 23, their adjacent ends are interlocked against relative fore and aft displacement by a interlocking member 314 which fits snugly but removably in aligned sockets 304 in the adjacent ends, as shown in FIG. 24.

It will now be understood that each base of each described embodiment of the invention includes rear upright wall means at the base side having front and rear surface means and upper edge means, i.e. the front and rear surfaces and upper edge of the rear base wall in FIGS. 1–13 and the front surfaces of socket blocks 208 and front wall surfaces of socket channels 220 and the upper end edges of the blocks between these surfaces in FIGS. 14–24. The backrest supporting posts on each base are disposed with their lower ends in seating contact with one of these surface means (the rear surface means) and with their horizontal bracket legs projecting over the edge means and their flanges depending along the other (front) surface means. The bracket screws are threaded against the latter surface means to releasibly secure the supporting posts in position on the base.

The inventor claims:

1. A modular bench seat construction comprising:

a rectangular base having front and rear sides and vertically facing sides normal to said front and rear sides, said base being adapted to be positioned with one of said vertically facing sides uppermost to form the top side of the base and the other vertically facing side lowermost to form the side of the base, a pair of backrest supporting posts having normally upper and lower ends, means releasibly attaching the lower ends of said posts to said rear base side at positions spaced along the latter side with the posts upright and rising above the said seat portion, a backrest portion secured to the upper ends of said posts, said base having a rear upright wall means at said rear base side having forwardly and rearwardly facing surface means and upper edge means at the top side of the base between and intersecting said forwardly and said rearwardly facing surface means, said lower post ends seating against said rearwardly facing surface means, the normally front sides of said post attaching means comprising generally L-shaped brackets fixed to said posts between the ends thereof including normally horizontal legs projecting forwardly over said edge means and vertical flanges depending along said forwardly facing surface means, and a seat portion removably positioned on the top side of said base with the rear edge of said seat portion resting on said normally horizontal bracket legs.

2. A modular bench seat construction comprising:

a rectangular base having front and rear sides and vertically facing sides normal to said front and rear sides, said base being adapted to be positioned with one of said vertically facing sides uppermost to form the top side of the base and the other vertically facing side lowermost to form the bottom side of the base, a seat portion removably positioned on the top side of said base, a pair of backrest supporting posts having normally upper and lower ends, means independent of said seat portion releasibly attaching the lower ends of said posts to said rear base side at positions spaced along the latter side with the posts upright and rising above the said seat portion, a backrest portion having normally horizontal edges and opening means entering one of said edges and removably positioned over said posts with the posts entering said opening means to removably support the backrest portion in an upright position along the rear edge of said seat portion, said posts, seat portion, and backrest portion comprising totally separate elements which may be assembled individually on said base to form a bench seat, said base having a rear upright wall means at said rear base side having front and rear surface means and upper edge means at the top side of the base, said lower post ends seating against one of said surface means, and said post attaching means comprising generally L-shaped brackets fixed to said posts between the ends thereof including normally horizontal legs projecting over said edge means and vertical flanges depending along the other surface means, and clamp screws threaded in said bracket flanges and against said latter surface means.

3. A modular bench seat construction comprising:

a rectangular base having front and rear sides and vertically facing sides normal to said front and rear sides, said base being adapted to be positioned with one of said vertically facing sides uppermost to form the top side of the base and the other vertically facing side lowermost to form the bottom side of the base, a seat portion removably positioned on the top side of said base, a pair of backrest supporting posts having normally upper and lower ends, means independent of said seat portion releasibly attaching the lower ends of said posts of said rear base side at positions spaced along the latter side with the posts upright and rising above the said seat portion, a backrest portion having normally horizontal edges and opening means entering one of said edges and removably positioned over said posts with the posts entering said opening means to removably support the backrest portion in an upright position along the rear edge of said seat portion, said posts, seat portion, and backrest portion comprising totally separate elements which may be assembled individually on said base to form a bench seat, said base having a rear wall means at said rear base side having an exposed edge at the top side of the base, said lower post ends seating against the rear side of said wall means, and said post attaching means comprising generally L-shaped brackets fixed to said posts between the ends thereof including horizontal legs projecting over the upper edge of said wall means and vertical flanges depending along the front said of said wall means, and clamp screws threaded in said bracket flanges and against said wall means.

4. A modular bench seat construction comprising:

a rectangular base having front and rear sides and vertically facing sides normal to said front and rear sides, said base being adapted to be positioned with one of said vertically facing sides uppermost to form the top side of the base and the other vertically facing side lowermost to form the bottom side of the base, a seat portion removably positoned on the top side of said base, a pair of backrest supporting posts having normally upper and lower ends, means independent of said seat portion releasibly attaching the lower ends of said posts to said rear base side at positions spaced along the latter side with the posts upright and rising above the said seat portion, a backrest portion having normally horizontal edges and opening means entering one of said edges and removably positioned over said posts with the posts entering said opening means to removably support the backrest portion in a upright position along the rear edge of said seat portion, said posts, seat portion, and backrest portion comprising totally separate elements which may be assembled individually on said base to form a bench seat, said base including upright upwardly opening sockets at said rear base side having side walls with upper end edges, said lower post ends being removably positioned endwise in said sockets, said post attaching means comprising generally L-shaped brackets fixed to said posts between their ends including normally horizontal legs projecting over said socket end edges and vertical flanges depending along the outer sides of said socket walls, and clamp screws threaded in said flanges and against said socket walls.

5. A modular bench seat construction according to claim 4 wherein:

said base has a rear wall, and said sockets are located at the front side of said rear wall.

6. A modular bench seat construction comprising:

a rectangular base having front and rear sides and vertically facing sides normal to said front and rear sides, said base being adapted to be positioned with one of said vertically facing sides uppermost to form the top side of the base and the other vertically facing side lowermost to form the bottom side of the base, a seat portion removably positioned on the top side of said base, a pair of backrest supporting posts having normally upper and lower ends, means independent of said seat portion releasibly attaching the lower ends of said posts to said rear base side at positions spaced along the latter side with the posts upright and rising above the said seat portion, a backrest portion having normally horizontal edges and opening means entering one of said edges and removably positioned over said posts with the posts entering said opening means to removably support the backrest portion in an upright position along the rear edge of said seat portion, said posts, seat portion, and backrest portion comprising totally separate elements which may be assembled individually on said base to form a bench seat, said base being adapted to be positioned with either vertically facing side uppermost to form the top side of the base and the other vertically facing side lowermost to form the bottom side of the base, said post attaching means comprising means for attaching said lower post ends to said base with the upper post ends projecting beyond either vertically facing side of said base, said seat portion being adapted to be positioned on either vertically facing side of said base, whereby said seat construction may be assembled with either vertically facing base side uppermost, said base having a rear upright wall means at said rear base side having front and rear surface means and normally horizontal edges at said vertically facing base sides, said lower post ends seating against one of said surface means, and said post attaching means comprising generally L-shaped brackets fixed to said posts between the ends thereof including normally horizontal legs projecting over the currently upper edge means and vertical flanges depending along the other surface means, and clamp screws threaded in said bracket flanges and against said latter surface means.

7. A modular bench seat construction comprising:

a rectangular base having front and rear sides and vertically facing sides normal to said front and rear sides, said base being adapted to be positioned with one of said vertically facing sides uppermost to form the top side of the base and the other vertically facing side lowermost to form the bottom side of the base, a seat portion removably positioned on the top side of said base, a pair of backrest supporting posts having normally upper and lower ends, means independent of said seat portion releasibly attaching the lower ends of said posts to said rear base side at positions spaced along the latter side with the posts upright and rising above the said seat portion, a backrest portion having normally horizontal edges and opening means entering one of said edges and removably positioned over said posts with the posts entering said opening means to removably support the backrest portion in an upright position along the rear edge of said seat portion, said posts, seat portion, and backrest portion comprising totally separate elements which may be assembled individually on said base to form a bench seat, said base being adapted to be positioned with either vertically facing side uppermost to form the top side of the base and the other vertically facing side lowermost to form the bottom side of the base, said post attaching means comprising means for attaching said lower post ends to said base with the upper post ends projecting beyond either vertically facing side of said base, said seat portion being adapted to be positioned on either vertically facing side of said base, whereby said seat construction may be assembled with either vertically facing base side uppermost, said base having a rear wall means at said rear base side with exposed edges at said vertically facing base sides, said lower post ends seating against the rear side of said wall means, and said post attaching means comprising generally L-shaped brackets fixed to said posts between the ends thereof including normally horizontal legs projecting over the currently upper edge of said wall means and vertical flanges depending along the front side of said wall means, and clamp screws threaded in said bracket flanges and against said wall means.

8. A modular bench seat construction comprising:

a rectangular base having front and rear sides and vertically facing sides normal to said front and rear sides, said base being adapted to be positioned with one of said vertically facing sides uppermost to form the top side of the base and the other vertically facing side lowermost to form the bottom side of the base, a seat portion removably positioned on the top side of said base, a pair of backrest supporting posts having normally upper and lower ends, means independent of said seat portion releasibly attaching the lower ends of said posts to said rear base side at positions spaced along the latter side with the posts upright and rising above the said seat portion, a backrest portion having normally horizontal edges and opening means entering one of said edges and removably positioned over said posts with the posts entering said opening means to removably support the backrest portion in an upright position along the rear edge of said seat portion, said posts, seat portion, and backrest portion comprising totally separate elements which may be assembled individually on said base to form a bench seat, said base being adapted to be positioned with either vertically facing side uppermost to form the top side of the base and the other vertically facing side lowermost to form the bottom side of the base, said post attaching means comprising means for attaching said lower post ends to said base with the upper post ends projecting beyond either vertically facing side of said base, said seat portion being adapted to be positioned on either vertically facing side of said base, whereby said seat construction may be assembled with either vertically facing base side uppermost, said base including upright sockets at said rear base side having open ends at said vertically facing base sides and having side walls with end edges bounding said open socket ends, said lower post ends being removably positioned in said sockets through their currently open upper ends, said post attaching means comprising generally L-shaped brackets fixed to said post between their ends including normally horizontal legs projecting over the currently upper socket end edges and vertical flanges depending along the outer sides of said socket walls, and clamp screws threaded in said flanges and against said socket walls.

9. A modular bench seat construction according to claim 8 wherein:

said base has a rear wall, and said sockets are located at the front side of said rear wall.

10. A modular bench seat construction according to claim 3 wherein:

said wall means comprises an exposed rear wall of said base, and said post securing means further comprise bolts extending through the lower post ends and said rear base wall midway between said rear wall edges.

11. A modular bench seat construction comprising:

a pair of rectangular bases each having front and rear sides, ends, and vertically facing sides normal to said front and rear sides and ends, each base being adapted to be positioned with one vertically facing side uppermost to form the top side of the base and the other vertically facing side lowermost to form the bottom side of the base, whereby each base may occupy either of two upright positions, said bases being arranged in an L-shaped configuration with one end of one base seating against the front wall of the other base and the rear side of said one base coplanar with one end of said other base, means releasibly joining said bases, a seat portion removably positioned on the topside of each base, a pair of backrest supportiing posts for each base having normally upper and lower ends, means independent of said seat portions releasibly attaching the lower ends of said posts to the rear side of the respective base at positions spaced along the latter side with the posts upright and rising above the corresponding said portion, a backrest portion for each base having normally horizontal edges and opening means entering one of said edges and removably positioned over the posts on the respective base with the posts entering said opening means to support the backrest portion in an upright position along the rear edge of the corresponding seat portion, and said posts, seat portions, and backrest portion comprising totally separate elements which may be assembled individually on said bases to form a bench seat.

12. A modular bench seat construction according to claim 11 wherein:

each base has a rear upright wall means at said rear base side having front and rear surface means and upper edge means at the top side of the base, said lower post ends seat against one of said surface means, and said post attaching means comprise generally L-shaped brackets fixed to said posts between the ends thereof including normally horizontal legs projecting over said edge means and vertical flanges depending along the other surface means, and clamp screws threaded in said bracket flanges and against said latter surface means.

13. A modular bench seat construction according to claim 11 wherein:

each base has a rear wall means at said rear base side having an exposed edge at the topside of the base, said lower post ends seat against the rear sides of the respective base wall means, and said post attaching means comprise generally L-shaped brackets fixed to said posts between the ends thereof including normally horizontal legs projecting over the upper edges of the respective wall means and vertical flanges depending along the front sides of the respective wall means, and clamp screws threaded in said bracket flanges and against side wall means.

14. A modular bench seat construction according to claim 11 wherein:

each base includes upright upwardly opening sockets at said rear base side having side walls with upper end edges, said lower post ends are removably positioned endwise in said sockets, said post attaching means comprise generally L-shaped brackets fixed to said posts between their ends including normally horizontal legs projecting over said socket end edges and vertical flanges depending along the outer sides of said socket walls, and clamp screws threaded in said flanges and against said socket walls.

15. A modular bench seat construction according to claim 14 wherein:

each base has a rear wall, and said sockets are located at the front side of said rear wall.

16. A modular bench seat construction according to claim 11 wherein:

each base is adapted to be positioned with either vertically facing side uppermost to form the topside of the base and the other vertically facing side lowermost to form the bottom side of the base, said post attaching means comprise means for attaching said lower post ends to the respective bases with the upper post ends projecting beyond either vertically facing side of the respective bases, and said seat portions are adapted to be positioned on either vertically facing side of said bases, whereby said seat construction may be assembled with either vertically facing base side uppermost.

17. A modular bench seat construction according to claim 16 wherein:

each base has a rear upright wall means at said rear base side having front and rear surface means and normally horizontal edges at said vertically facing base sides, said lower post ends seat against one of said surface means, and said post attaching means comprise generally L-shaped brackets fixed to said posts between the ends thereof including normally horizontal legs projecting over the currently upper edge means and vertical flanges depending along the other surface means, and clamp screws threaded in said bracket flanges and against said latter surface means.

18. A modular bench seat construction according to claim 16 wherein:

each base has a rear wall means at said rear base side having exposed edges at said vertically facing base sides, said lower post ends seat against the rear sides of the respective base wall means, and said post attaching means comprise generally L-shaped brackets fixed to said posts between the ends thereof including normally horizontal legs projecting over the currently upper edges of the respective wall means and vertical flanges depending along the front side of the respective wall means, and clamp screws threaded in said bracket flanges and against the respective wall means.

19. A modular bench seat construction according to claim 16 wherein:

each base includes upright sockets at said rear base side having open ends at said vertically facing base sides and having side walls with end edges bounding said open socket ends, said lower post ends are removably positioned in said sockets through their currently open upper ends, said post attaching means comprise generally L-shaped brackets fixed to said post between their ends including normally horizontal legs projecting over the currently upper socket end edges and vertical flanges depending along the outer sides of said socket walls, and clamp screws threaded in said flanges and against said socket walls.

20. A modular bench seat construction according to claim 19 wherein:

each base has a rear wall, and said sockets are located at the front side of said rear wall.

21. a modular bench seat construction according to claim 18 wherein:

said wall means of each base comprises and exposed rear wall of the base, and said post securing means comprises bolts extending through the lower post ends and the respective rear base walls midway between said rear wall edges.

22. A modular bench seat construction according to claim 11 wherein:

the adjacent ends of said backrest portions are spaced at the rear corner of said seat construction, said seat construction includes a corner portion between said adjacent backrest portion edges having openings entering its lower edge, a pair of additional supporting posts removably entering said corner portion edge openings, and means releasibly attaching the lower ends of said latter posts to the rear side and said one end, respectively, of said other base with the latter posts upright and rising above the latter base to removably support said corner portion in an upright position between said backrest portions with the adjacent backrest and corner portion edges closely adjacent one another.

23. A modular bench seat construction according to claim 22 including:

means releasibly engaging between said backrest and corner portions along the adjacent edges thereof for restraining said adjacent edges against relative lateral movement.

24. A modular bench seat construction according to claim 22 including:

springs fixed to certain of said posts for urging the adjacent edges of said backrest and corner portions into abutting contact.

25. A modular bench seat construction according to claim 24 including:

means rigidly joining each pair of adjacent corner and backrest portion supporting posts.

26. A modular bench seat construction comprising:

a pair of rectangular bases each having front and rear sides, ends, and vertically facing sides normal to said front and rear sides and ends, each base being adapted to be positioned with either vertically facing side uppermost to form the topside of the base and the other vertically facing side lowermost to form the bottom side of the base, whereby each base may occupy either of two upright positions, said bases being arranged in an L-shaped configuration with one end of one base closely adjacent against the front side of the other base and the rear side of said one base coplanar with one end of said other base, means for releasibly joining said bases, a seat portion removably positionable on the topside of each base in either upright position thereof, a backrest portion for each base, means independent of said seat portions for releasibly securing each backrest portion in an upright position to its respective base along the rear base side in either upright position of the base, and said seat portions and backrest portions comprising totally separate elements which may be assembled individually on said bases with either vertically facing base sides uppermost to form a bench seat.

27. A modular bench seat construction according to claim 26 wherein:

the adjacent edges of the two backrest portions are spaced at the rear corner of said seat construction when the latter is assembled with said bases in either upright position thereof, a corner portion positionable between said adjacent backrest portion edges with the adjacent backrest and corner portion edges in close proximity to one another, and means independent of said seat and backrest portions for rreleasibly securing said corner portion to said other base in either upright position thereof.

28. A modular bench seat construction according to claim 27 including:

means releasibly engageable between the adjacent backrest and corner portion edges for restraining the latter edges against relative lateral movement.

29. A modular bench seat construction according to claim 28 wherein:

said restraining means comprise flanges on the ends of said corner portion engaging behind the adjacent ends of said backrest portions.

30. A modular bench seat construction according to claim 28 wherein:

said restraining means comprise interengaging lug and socket means at the adjacent ends of said corner and backrest portions.

31. A modular bench seat construction according to claim 22 wherein:

said corner portion is invertable and has a removable top plate.

32. A modular bench seat construction according to claim 31 wherein:

said corner top plate includes a depending backrest cushion along its front edge.

33. A modular bench seat construction comprising:

a pair of rectangular bases each having front and rear sides, ends, and vertically facing sides normal to said front and rear sides and ends, each base being adapted to be positioned with either vertically facing side uppermost to form the topside of the base and the other vertically facing side lowermost to form the bottom side of the base, whereby each base may occupy either of two upright positions, said bases being arranged end-to-end, means for releasibly joining said bases, a seat portion removably positionable on the topside of each base in eitherupright position thereof, a backrest portion of each base, means independent of said seat portion of releasibly securing each backrest portion in an upright position to its respective base along the rear base side in either upright position of the base, and said seat portions and backrest portions comprising totally separate elements which may be assembled individually on said bases with either vertically facing base sides uppermost to form a bench seat.

34. A modular bench seat construction according to claim 33 including:

means releasibly restraining the adjacent end of said backrest portions against relative fore and aft displacement.

35. A modular bench seat construction according to claim 34 wherein:

said restraining means comprises releasibly interengaging lug and socket means at said adjacent ends of said backrest portions.

36. A modular bench seat construction according to claim 35 wherein:

said lug and socket means comprise sockets in the ends of said backrest portions, and a lug extending between said adjacent end of said backrest portions and removably engaging in the corresponding sockets.

* * * * *